US006751931B2

(12) United States Patent
Cere'

(10) Patent No.: US 6,751,931 B2
(45) Date of Patent: Jun. 22, 2004

(54) METHOD FOR WRAPPING GROUPS OF PRODUCTS WITH STRETCH FILM

(75) Inventor: Mauro Cere', Loiano (IT)

(73) Assignee: Aetna Group, S.p.A., Rimini (IT)

( * ) Notice: Subject to any disclaimer, the term of this patent is extended or adjusted under 35 U.S.C. 154(b) by 0 days.

(21) Appl. No.: 10/173,725

(22) Filed: Jun. 18, 2002

(65) Prior Publication Data

US 2003/0024213 A1 Feb. 6, 2003

(30) Foreign Application Priority Data

Aug. 3, 2001 (EP) ..... 01830521

(51) Int. Cl.[7] ..... B65B 11/00
(52) U.S. Cl. ..... 53/397; 53/441; 53/461
(58) Field of Search ..... 53/397, 398, 399, 53/441, 449, 461, 556, 567, 585, 575, 459

(56) References Cited

U.S. PATENT DOCUMENTS

| | | | | |
|---|---|---|---|---|
| 2,955,941 A | * | 10/1960 | Hultkrans et al. | 53/556 |
| 3,264,796 A | * | 8/1966 | Tomczak et al. | 53/556 |
| 3,479,930 A | * | 11/1969 | Peppler | 53/556 |
| 3,710,539 A | * | 1/1973 | Cothran et al. | 53/441 |
| 3,974,628 A | * | 8/1976 | Konstantin | 53/585 |
| 4,005,777 A | | 2/1977 | Marantz | |
| 4,454,705 A | * | 6/1984 | Benno | 53/441 |
| 4,607,476 A | * | 8/1986 | Fulton, Jr. | 53/556 |
| 4,712,354 A | | 12/1987 | Lancaster et al. | |
| 4,730,436 A | | 3/1988 | Angelino | |
| 5,168,989 A | * | 12/1992 | Benno | 53/399 |
| 5,182,894 A | | 2/1993 | Bate | |
| 5,566,530 A | * | 10/1996 | Johnstone et al. | 53/441 |
| 5,628,168 A | * | 5/1997 | Inman et al. | 53/575 |
| 6,082,254 A | * | 7/2000 | De Vlaam | 53/575 |
| 6,161,365 A | * | 12/2000 | Girard et al. | 53/441 |

FOREIGN PATENT DOCUMENTS

| | | |
|---|---|---|
| DE | 39 10823 A1 | 10/1990 |
| EP | 0 459 670 A1 | 12/1991 |
| IT | 1285827 | 6/1998 |

* cited by examiner

*Primary Examiner*—John Sipos
*Assistant Examiner*—Louis Huynh
(74) *Attorney, Agent, or Firm*—Fay, Sharpe, Fagan Minnich & McKee, LLP

(57) ABSTRACT

A method for wrapping groups of products with stretch film comprises the following steps: forming groups of products having a front and a longitudinal dimension following a line of feed; winding a stretch film unrolled from a first roll around a plurality of stretching rods positioned inside a film wrapping area and along the product group line of feed; forming a first tubular portion of stretch film; stretching the portion of film by moving the plurality of stretching rods to create an access area, whose transversal dimension is larger than the front, for a single group of products moving along the feed line; releasing the film portion to allow the portion to shrink and thus wrap over the group of products and thus wrapping it; expelling the wrapped package thus obtained onto the feed line.

21 Claims, 3 Drawing Sheets

METHOD FOR WRAPPING GROUPS OF PRODUCTS WITH STRETCH FILM

BACKGROUND OF THE INVENTION

The present invention relates to a method and apparatus for wrapping groups of products with stretch film, where the grouped products are bottles with bases of different shapes—for example, circular, square or rectangular—or even containers made of metal (including parallelepiped shaped containers).

In conventional production lines where the production process includes the wrapping of groups of plastic bottles (to which the present description will hereinafter refer, although the invention may also be applied to other types of product or container), the final wrapping over the groups of bottles usually consists of a sheet of heat-shrink material.

In some cases and for some types of products, these lines may, however, be very expensive for the manufacturer because they have numerous operating units, such as product collating units (especially in the case of continuous lines), and film feed and heating units, all of which require a high number of control devices and accessory parts, not to mention the high cost of the heat shrink film itself. Another limiting factor on production lines of this kind is the fact that some products cannot be heated beyond certain limits, which means that heat shrink wrapping solutions are not feasible.

The teachings of prior art also include more economical wrapping solutions adopted instead of heat shrink wrapping methods and machines, but providing standards of quality that are at least as high as those provided by heat shrink wrapping solutions.

One of these alternative solutions is described in patent IT 1.285.827, in the name of the same Applicant as the present. In this solution, a tubular portion of stretch film, that is to say, elastically extensible film, is used in a method where the portion of film is fed by a film feed station and then stretched transversally by a plurality of rods. In this way, the size of the tubular portion of film is enlarged so that its transversal dimension is increased from a minimum size to a size greater than the front of the groups of products. The rods then align the film with the line of product feed so as to enable a single group of products to move into the stretched tube of film. The rods, moving in synchrony with the feed motion of the groups of products, then release the tube of film allowing it to shrink to its former size in such a way that it envelops the package.

This wrapping method is extremely practical, fast and economical compared to heat shrink wrapping methods and its use is currently preferred for many type of products—whether bottles or other containers—to be wrapped with film.

Consequently, the demand for stretch wrapping has increased considerably. This has been accompanied by a corresponding increase in the need to change some of the steps in the stretch wrapping process and the structure of stretch wrapping equipment which, at present, is cumbersome and takes up a large amount of factory space.

Starting from the wrapping method briefly described above and through continual research and development, the Applicant has invented a new method for wrapping groups of products with stretch film. The new method is extremely fast and provides a very strong, high-quality end package.

The invention also has for an object to provide an apparatus that implements this method and that is compact, fast and very reasonably priced.

SUMMARY OF THE INVENTION

Accordingly, the present invention provides a method for wrapping groups of products with stretch film comprising the following steps: forming groups of products having a front and a longitudinal dimension that follows a line of feed; winding a stretch film unrolled from a first roll around first means for preforming the wrapping, positioned inside a film wrapping area and along the product group line of feed; forming a first tubular portion of stretch film; stretching the portion of film by moving the first preforming means to create an access area for a single group of products moving along the feed line, the transversal dimension of the access area being larger than the front of the group of products; releasing the portion of stretch film to allow the film to shrink to its former size over the group of products and thus wrapping it; expelling the wrapped package thus obtained onto the feed line.

BRIEF DESCRIPTION OF THE DRAWINGS

The technical features of the present invention, in accordance with the above mentioned aims, are set out in the claims below and the advantages more clearly illustrated in the detailed description which follows, with reference to the accompanying drawings, which illustrate preferred embodiments of the invention without restricting the scope of the inventive concept, and in which:

DESCRIPTION OF THE PREFERRED EMBODIMENTS

Figure 1:
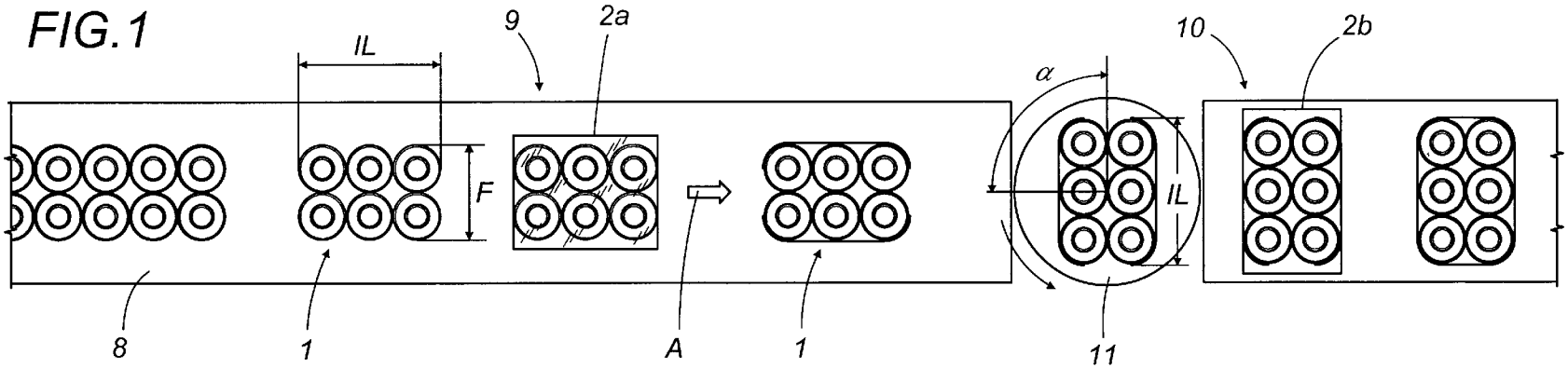
FIG. 1 is a schematic top plan view illustrating the method according to the present invention.

With reference to the accompanying drawings described above, and with reference in particular to FIG. 1, the method and apparatus according to the invention are used to wrap groups 1 of products with stretch film 2.

The accompanying drawings illustrate bottles with circular bases purely as an example of the type of product that can be stretch wrapped. However, without departing from the scope of the inventive concept, the method and apparatus according to the invention can be used to wrap bottles of different shapes—for example with square or rectangular bases—or containers made of metal (including parallelepiped shaped containers) such as beverage cans.

The wrapping method disclosed herein comprises the following steps (see FIGS. 1 and 2):

- forming groups 1 of products having a front F and a longitudinal dimension IL following a line of feed A (see arrow A in FIGS. 1, 2 and 6);
- winding a stretch film 2 unrolled from a first roll 3 around first means 4 for preforming the wrapping, positioned inside a film 2 wrapping area and along the product group 1 line of feed A;

forming a first tubular portion 2*a* of stretch film 2;

stretching the portion 2*a* of film by moving the first preforming means 4 to create an access area, whose transversal dimension is larger than the front F, for a single group 1 of products moving along the feed line A;

releasing the film portion 2*a* to allow the portion 2*a* to shrink to its former size, in such a way that the group 1 of products is wrapped in the film portion 2*a* as the latter elastically returns to its original size;

expelling the wrapped package thus obtained onto the feed line A.

Figure 2:
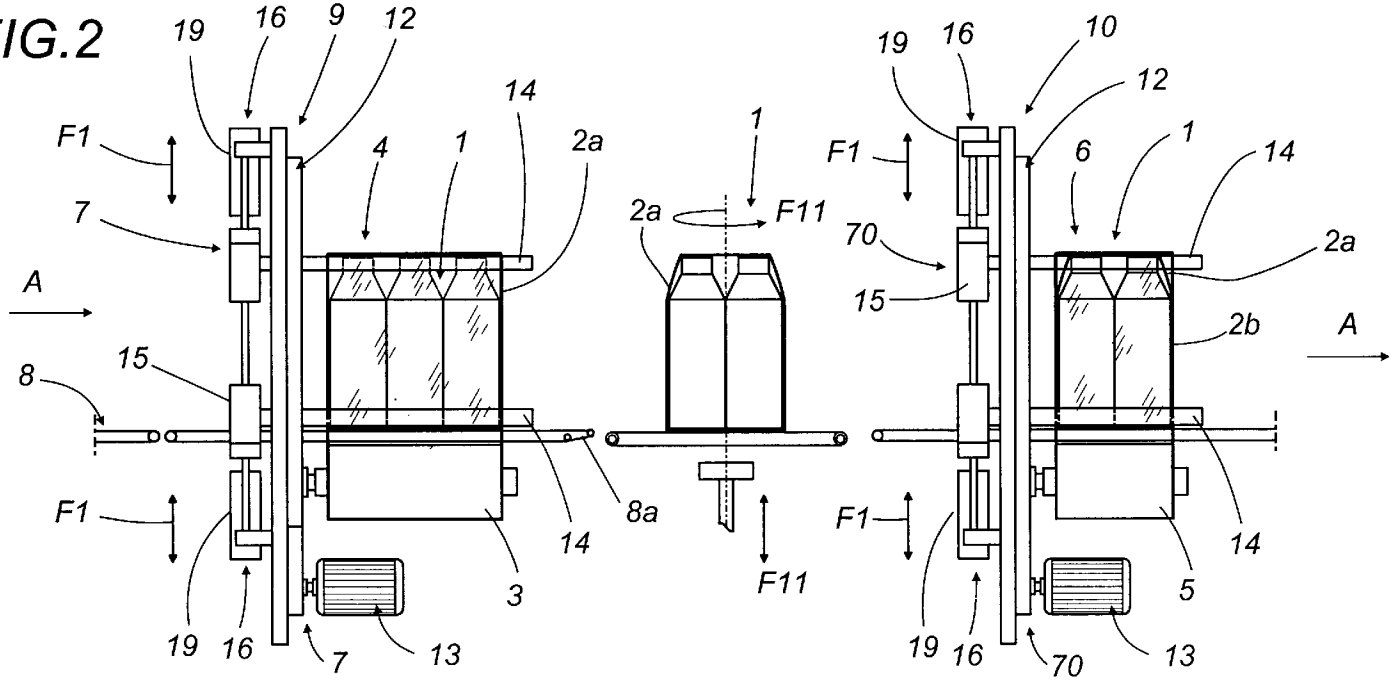
FIG. 2 is a schematic side view of an apparatus implementing the method illustrated in FIG. 1.

As clearly shown in FIGS. 1 and 2, the step of expelling the once wrapped package is followed by a further step of overwrapping the package with a second wrap of stretch film 2 unwound from a second roll 5.

Between the step of expelling the package and the step of wrapping it for a second time, the package is preferably turned by an angle α corresponding to 90°.

In practice, the second wrap is placed on the package over the first wrap in such a way as to fully cover the package on all four sides on the same wrapping line.

The step of overwrapping the package with a second wrap comprises the following further steps:

winding a stretch film 2 unrolled from a second roll 5 around second means 6 for preforming an overwrapping, positioned inside a film wrapping area and along the product group 1 line of feed A;

forming a second tubular portion 2*b* of stretch film 2;

stretching the second portion 2*b* of film by moving the second preforming means 6 to create an access area for the package moving along the feed line A;

releasing the second film portion 2*b* to allow the portion 2*b* to shrink to its former size in such a way as to overwrap the package;

expelling the fully wrapped package thus obtained onto the feed line A.

The step of stretching the second film portion 2*b* forms an access area whose transversal dimension is larger than the longitudinal dimension IL of the group 1 of products so as to obtain a sealed package where all four sides of the product group 1 are covered.

Again with reference to FIG. 1, the length of the film portion 2*a* is substantially the same as the longitudinal dimension IL of the group 1 of products.

As shown in FIG. 2, the step of winding the film 2 the first time may be effected by rotating the first roll 3 around the first means 4 for preforming the wrapping.

Figure 4:
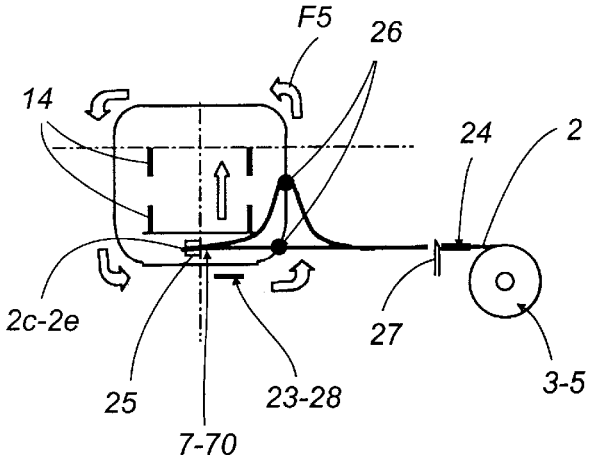
FIGS. 4 and 5 are schematic front views showing two different operating configurations of another embodiment of one of the stations forming part of the apparatus illustrated in FIGS. 2 and 3.
Figure 5:
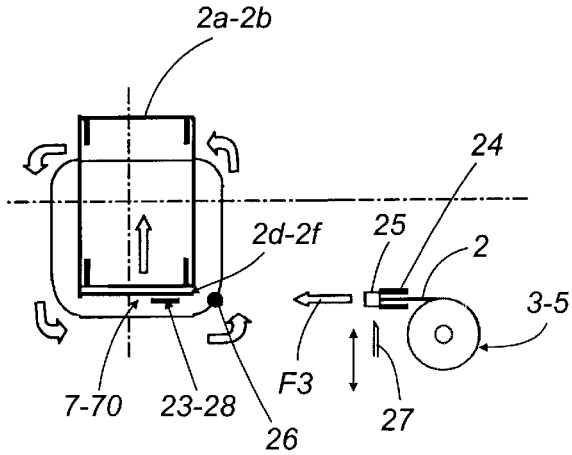

In another embodiment, see FIGS. 4 and 5, the step of winding the film 2 the first time may be effected using first means 7 to unroll the film 2 from the first roll 3, which is fixed, and then winding the film around the first means 4 for preforming the wrapping.

Similarly, the step of winding the film 2 the second time may be effected using second means 70 to unroll the film 2 from the second roll 5, which is fixed, and then winding the film around the second means 6 for preforming the overwrapping.

The steps of forming the first and second portions of film 2*a* and 2*b* each comprise the following further steps:

overlapping the two ends 2*c*, 2*d*; 2*e*, 2*f* of each of the corresponding unrolled portions 2*a* and 2*b* at the bottom of the corresponding winding;

permanently joining the ends 2*c*, 2*d*; 2*e*, 2*f* to form the corresponding first and second tubular portions 2*a* and 2*b*.

If the step of winding the portions 2*a* and 2*b* is effected by turning the first and second rolls 3 and 5 around the first and second preforming means 4 and 6, there may be a step of cutting the film 2 between the step of overlapping the ends of the unrolled portions and the step of joining them.

Instead, if the two rolls 3 and 5 are fixed, the cutting step is preferably carried out before the overlapping step.

The joining step may consist in heat sealing the ends 2*c*, 2*d*; 2*e*, 2*f* of the two portions 2*a* and 2*b*.

Figure 3:
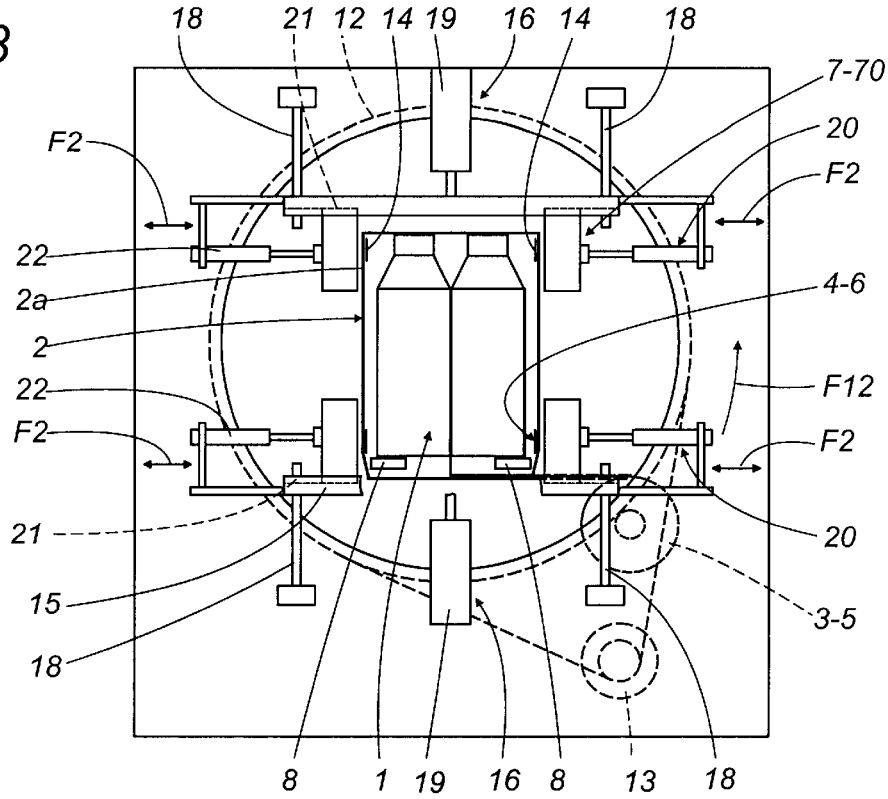
FIG. 3 is a schematic front view, with some parts cut away in order to better illustrate others, of a detail of the apparatus shown in FIG. 2.

As shown in FIG. 3, the stretching step may be effected by moving the first and second means 4 and 6 in a vertical direction (see arrows F1). Alternatively, in the case of low products, the stretching step may be effected by moving the first and second means 4 and 6 in a horizontal direction (see arrows F2 in FIG. 3).

The method described above is implemented by an apparatus that essentially comprises the following:

a table 8 along which the products are fed in the direction A to form the groups 1 having the front F and the longitudinal dimension IL;

a first wrapping station 9 located on the table 8 and forming part of the table 8 itself, and equipped with: the aforementioned means 7 for unrolling the stretch film 2 and forming the first portion 2*a* of the film 2 wound around the first means 4 for preforming the wrapping positioned on the feed table 8 and moving between different working positions, comprising the following:

a fully closed position designed to allow the film 2 to be wound around the first means 4 themselves (see FIG. 4);

a position for infeed of the product group 1 in which the first means 4 stretch the first tubular film portion 2*a* in such a way that the transversal dimension of the first portion 2*a* is larger than the front F of the product group 1 (see FIG. 5); and a position for expelling the wrapped package onto the feed table 8.

The formation of the groups of products upstream of the first station 9 is not described in detail since it is a well known process and does not strictly form part of the invention.

Downstream of the first wrapping station 9, in the feed direction A, there is a second station 10 for overwrapping the package with the second tubular portion 2*b* of stretch film 2.

Preferably, between the first and second stations 9 and 10 there is a turntable 11 forming part of the feed table 8 and designed to turn each package through an angle a corresponding to 90°.

Figure 6:
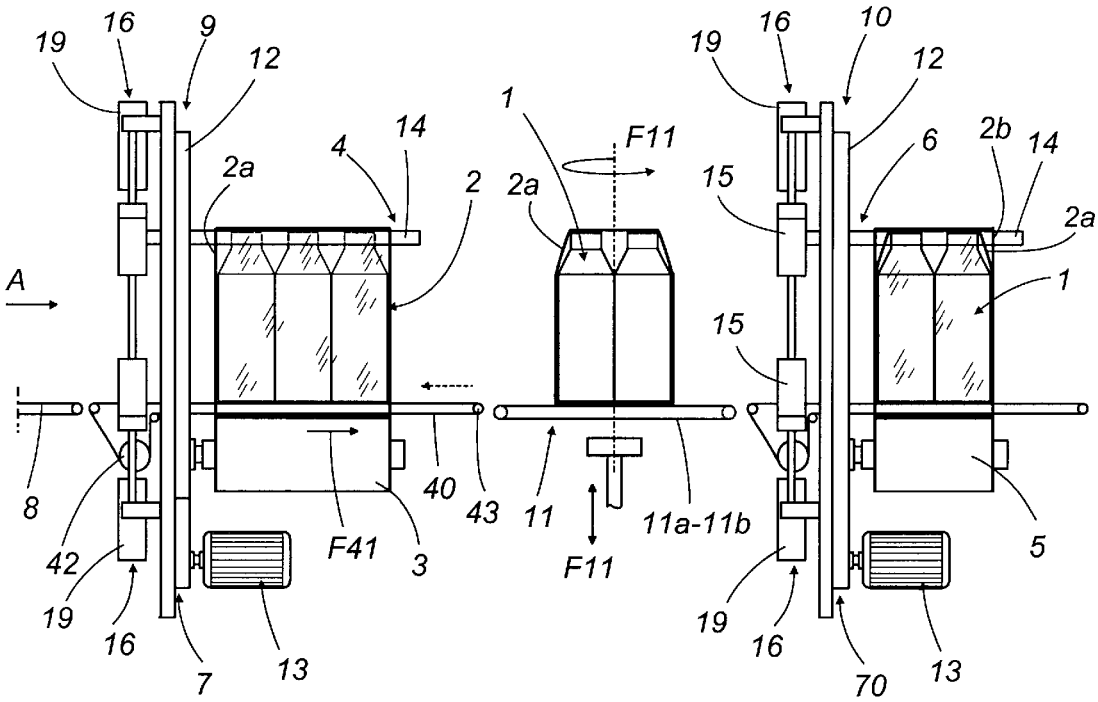
FIGS. 6 and 7 are, respectively, a schematic side view and a schematic front view, with some parts cut away in order to better illustrate others, of another embodiment of the apparatus according to the invention.

Looking in more detail at a non-restrictive, preferred embodiment described purely by way of example, the turntable 11 may comprise a pair of belts 11*a* and 11*b* for feeding the group of products and a lifting element 11*c*, positioned between the pair of belts 11*a* and 11*b*, which lifts and turns the group 1 of products and then lowers the product group 1 back onto the pair of belts 11*a* and 11*b* (see arrows F11 in FIGS. 2 and 6).

Structurally, the second station 10 is similar to the first station 9 and may comprise the aforementioned second means 70 for unrolling the stretch film 2 and forming the second portion 2*b* of film around the second means 6 for preforming the overwrapping.

The second preforming means 6 are also positioned on the feed table 8 and can move between different working positions, comprising: the aforementioned fully closed position designed to allow the film 2 to be wound around the second means 6; the position for infeed of the package where the second means 6 stretch the second portion 2*b* of film in such a way that the longitudinal dimension of the film 2 is greater than the longitudinal dimension IL of the package; and a position for expelling the twice wrapped group 1 of products onto the feed table 8.

In a first embodiment, the aforementioned unwinding means 7 and 70 each comprise a ring-shaped structure 12 mounting one of the mobile rolls 3 and 5 of stretch film driven by a corresponding motor 13 along the ring 12 (see arrow F12) and around the first and second preforming means 4 and 6.

Looking in more detail, the first and second preforming means 4 and 6 each comprise a plurality of rods 14 mounted on a frame 15 and set apart from each other in such a way as to form a tubular space close to the feed table 8.

Each frame 15 is equipped with means 16 for moving the rods 14 towards and away from each other in such a way as to define the aforementioned fully closed, infeed and expulsion positions.

More specifically, there may be four rods 14 mounted on the frame 15. The frame 15 is gantry shaped and equipped with drive means 16 which, in a first embodiment, are designed to move the rods 14 towards and away from each other vertically in both directions (see arrow F1), the rods 14 being positioned side by side in pairs in a horizontal plane.

To accomplish this, the frame 15 is slidably supported by a pair of parallel, vertical guides 18 and is equipped with a pair of opposing drive cylinders 19 constituting the drive means 16 and designed to cause the aforementioned vertical movement of the rods 14 towards and away from each other.

Preferably, the rods 14 are equipped with belts (not illustrated) to enable rapid expulsion of the film portions 2*a*, 2*b*.

In an alternative solution, the four rods 14 are again mounted on a gantry shaped frame 15 but in this case equipped with drive means 20 designed to move the rods 14 towards and away from each other horizontally in both directions, the rods 14 being positioned side by side in pairs in a vertical plane.

Looking in more detail, the frame 15 is slidably supported by a pair of parallel, horizontal guides 21 (preferably formed on the frame 15 itself) and is equipped with a pair of opposing drive cylinders 22 constituting the drive means 20 and designed to cause the aforementioned horizontal movement of the rods 14 towards and away from each other.

In the accompanying drawings, the numeral 23 generically denotes heat sealing means fitted in both the first and the second stations 9 and 10 and designed to join the free ends 2*c*, 2*d*; 2*e*, 2*f* of the stretch film 2 that are overlapped when the film 2 is wound around the first and second preforming means 4 and 6.

FIGS. 4 and 5 illustrate another embodiment of the first and second unwinding means 7 and 70 which comprise:

- the first and second rolls 3 and 5, which are fixed and are positioned near the feed table 8;
- a first fixed gripper 24 for holding the free end of the stretch film 2 of the rolls 3 and 5;
- a second gripper 25 that moves in a horizontal plane (see arrow F3 in FIG. 5), to hold and transport the stretch film 2 to the area forming the bottom of the winding close to the first and second preforming means 4 and 6;
- a third, mobile gripper 26 that grips a part of the film 2 unwound by the second mobile gripper 25 and transports the film 2 around the first and second preforming means 4 and 6 (see arrow F5 in FIG. 4).

In the embodiment just described, the numeral 27 denotes means for cutting the stretch film 2 located near the first, fixed gripper 24 and coming into operation when the third, mobile gripper 26 is activated in such a manner as to form the portions 2*a*, 2*b* of the stretch film 2.

FIG. 5 schematically shows an element 28 for joining the overlapping free ends 2*c*, 2*d*; 2*e*, 2*f* of the film 2 held, respectively, by the second and third grippers 25 and 26 after the film 2 has been wound around the first and second preforming means 4 and 6.

As shown in FIGS. 2 to 5, the winding of the film 2 around the preforming means 4 and 6 is facilitated by the feed table 8 whose forward motion when the rods 14 move towards each other causes the film portion to be expelled from the rods 14 themselves.

To facilitate the release of the portions 2*a*, 2*b* as they are being expelled, the feed table 8 may have a tapered end part 8*a* that is separate from the rest of the feed table 8: in this way, the film portions 2*a*, 2*b* may move upwards as they shrink in such a way as to adhere to the bases of the products.

As shown in FIG. 6, the feed table 8 may consist, at least at the first and second stations 9 and 10, of respective pairs of separate, parallel belts 40, 41 which also constitute the bottom pair of rods 14 for winding the film 2.

In practice, at the stations 9 and 10, the pair of belts 40 and 41 form extensions of the traditional feed table 8, each being power-driven, moving in a closed loop around the pair of wheels 42 and 43, supported at the ends by the frame 15 of each station 9 and 10.

Figure 7:
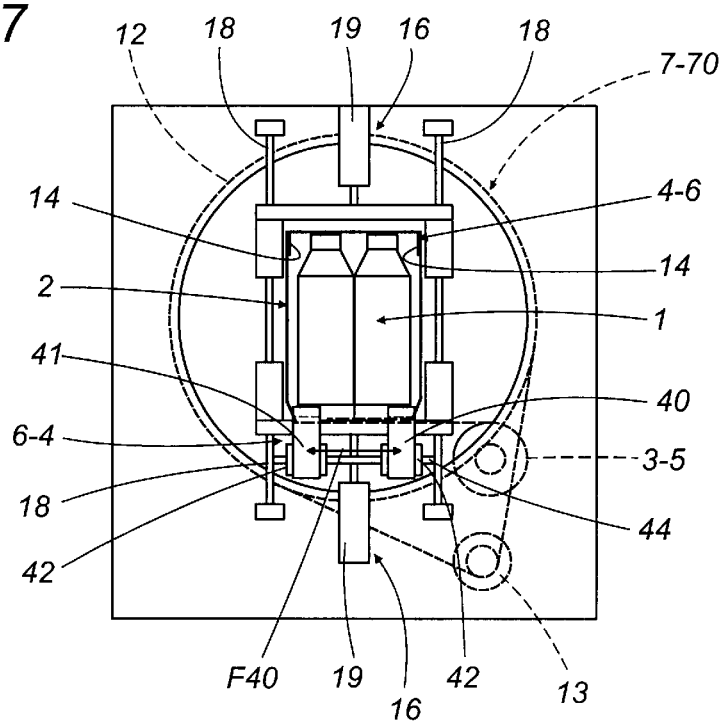

The belts 40 and 41 can move towards and away from each other (see arrows F40 in FIG. 7) to adapt to the size of the group 1 of products, thanks to the horizontal supporting guides 44, which are connected to the guides 18 driven by the cylinders 19.

The adjustment of the belts 40 and 41 makes it possible to perform the aforementioned steps of winding, stretching and releasing the film with a vertical movement. It also permits the expulsion of the product group 1 thanks to the possibility of reversing the direction of travel of the belts 40 and 41 (see arrow F41) which feed the product group 1 with the film 2 wound around it. The belts 40 and 41 may also have tapering ends to release the film 2 and allow it to adhere to the bases of the products.

The stretch wrapping method and apparatus described above achieve the purpose of wrapping the groups of products extremely rapidly with a high-quality wrap, irrespective of the type of product to be wrapped.

The possibility of applying a double wrap on the same package increases both the quality and safety of the end package while keeping overall costs within acceptable levels.

The structural design of the apparatus allows the products to be rapidly wrapped in line, thus considerably reducing the costs and size of the equipment required, while increasing its productivity.

The invention described can be subject to modifications and variations without thereby departing from the scope of the inventive concept. Moreover, all the details of the invention may be substituted by technically equivalent elements.

What is claimed is:

1. A method for wrapping groups of products with stretch film comprising the following steps:

forming groups of products having a front and a longitudinal dimension following a line of feed;

winding a stretch film unrolled from a first roll around first means for preforming a wrapping positioned inside a film wrapping area and along the product group line of feed;

forming a first tubular portion of stretch film from the stretch film wound around the first means for preforming a wrapping;

separating said first tubular portion from the stretch film unrolled from the first roll;

stretching the first tubular portion of film by moving the first means for preforming a wrapping to create an access area having a transversal dimension that is larger than the front of a single group of products moving along the feed line;

inserting at least the single group of products into the stretched first tubular portion through the access area;

releasing the first tubular portion to allow the first tubular portion to shrink in such a way that at least the single group of products is wrapped in the film portion to form a wrapped package;

expelling the wrapped package.

2. The method according to claim 1, wherein the expelling step is followed by a further step of applying over the wrapped package a second wrapping of stretch film unrolled from a second roll.

3. The method according to claim 2, wherein, between the step of expelling the package and the step of applying over the package a second wrapping of stretch film, the package is turned by an angle of 90°.

4. The method according to claim 3, wherein the step of applying the second wrapping to the package comprises the following further steps:

winding a stretch film unrolled from the second roll around second means for preforming an overwrapping positioned inside a film wrapping area and along the product group line of feed;

forming a second tubular portion of stretch film from the stretch film wound around the second means;

separating said second tubular portion from the stretch film unrolled from the second roll;

stretching the second tubular portion of film by moving the second means for preforming to create an access area for the package moving along the feed line;

inserting the package into the stretched second tubular portion through the access area;

releasing the second film portion to allow the second film portion to shrink in such a way as to overwrap the package;

expelling the fully wrapped package.

5. The method according to claim 4, wherein the step of stretching the second film portion forms an access area having a transversal dimension that is larger than the longitudinal dimension of the group of products so as to obtain a sealed package where all four sides of the product group are covered.

6. The method according to claim 4, wherein the step of winding the stretch film from the second roll is performed by rotating the second roll around the second means for preforming the overwrapping.

7. The method according to claim 4, wherein the step of winding the stretch film from the second roll is performed using second means to unroll the film from the second roll, which is fixed, and then winding the film around the second means for preforming the overwrapping.

8. The method according to claim 4, wherein the step of forming the second film portion comprises at least the following further steps:

overlapping a free end of the stretch film over the unrolled stretch film at the bottom of the second means;

permanently joining the ends of the unrolled portion of film at the bottom of the winding to form the second tubular portion.

9. The method according to claim 8, wherein between the overlapping step and the joining step there is a step of cutting the film wound by the second roll.

10. The method according to claim 8, wherein the overlapping step is preceded by a step of cutting the film from the second roll before the film winding step.

11. The method according to claim 8, wherein the joining step comprises a further step of heat sealing the ends of the unrolled portion of film at the bottom of the winding.

12. The method according to claim 4, wherein the stretching of the first and second tubular portions are performed by moving the first and second, espectively in a vertical direction.

13. The method according to claim 4, wherein the stretching step is performed by moving the first and second preforming means in a horizontal direction.

14. The method according to claim 2, wherein the second wrapping is applied over the first tubular portion.

15. The method according to claim 1, wherein at least the first film portion has substantially the same length as the longitudinal dimension of the product group.

16. The method according to claim 1, wherein the step of winding the stretch film around the first means is performed by rotating the first roll around the first means for preforming the wrapping.

17. The method according to claim 1, wherein the step of winding the stretch film around the first means is performed using first means to unroll the film from the first roll, which is fixed, and then winding the film around the first means for preforming the wrapping.

18. The method according to claim 1, wherein the step of forming the first film portion comprises at least the following further steps:

overlapping a free end of the stretch film over the unrolled stretch film at the bottom of the first means;

permanently joining the ends of the unrolled portion to form the first tubular portion.

19. The method according to claim 18, wherein between the overlapping step and the joining step there is a step of cutting the film wound by the first roll.

20. The method according to claim 18, wherein the overlapping step is preceded by a step of cutting the film from the first roll before the film winding step.

21. The method according to claim 10, wherein the joining step comprises a further step of heat sealing the ends of the unrolled portion.

* * * * *